United States Patent [19]

Stoffo

[11] Patent Number: 5,060,943

[45] Date of Patent: Oct. 29, 1991

[54] GRIPPING AID

[75] Inventor: Lillian M. Stoffo, Hudson, Fla.

[73] Assignee: Durasol Corporation, Amesbury, Mass.

[21] Appl. No.: 419,110

[22] Filed: Oct. 10, 1989

[51] Int. Cl.[5] ..... A63B 57/00

[52] U.S. Cl. ..... 273/32 B; 273/DIG. 30; 273/162 F; 401/195; 206/210

[58] Field of Search ..... 273/67 DB, 81 D, 75, 273/DIG. 30, 25, 29 R, 32 B, 148 R, 162 F; 16/116 A; 15/209 R, 210 R; 206/205, 210; 2/279, DIG. 6; 401/195

[56] References Cited

U.S. PATENT DOCUMENTS

| | | | |
|---|---|---|---|
| 2,574,854 | 11/1951 | West | 15/209 R |
| 2,669,737 | 2/1954 | Evans | 15/209 R X |
| 2,779,465 | 1/1957 | Anderson | 15/209 R X |
| 3,083,392 | 4/1963 | Sewell | 15/209 R X |
| 3,760,461 | 9/1973 | Wright | 15/209 R X |
| 3,845,954 | 11/1974 | Case | 273/75 |
| 4,040,632 | 8/1977 | Pawl | 273/DIG. 30 |
| 4,224,712 | 9/1980 | Black et al. | 15/209 R |
| 4,347,280 | 8/1982 | Lau et al. | 273/67 DB |
| 4,403,366 | 9/1983 | Lucke | 15/209 R |
| 4,448,560 | 5/1984 | Monaco | 206/205 X |
| 4,516,616 | 5/1985 | Fesler | 15/209 R X |
| 4,567,091 | 1/1986 | Spector | 273/81 D |
| 4,684,559 | 8/1987 | Wasko | 273/81 D |
| 4,706,673 | 11/1987 | Meistrell | 128/402 |
| 4,771,478 | 9/1988 | Bisagno | 2/DIG. 6 X |
| 4,771,502 | 9/1988 | Trimble | 15/209 R |
| 4,933,015 | 6/1990 | White | 15/209 R X |

FOREIGN PATENT DOCUMENTS

| | | | |
|---|---|---|---|
| 2039830 | 8/1980 | United Kingdom | 273/75 |

*Primary Examiner*—Edward M. Coven
*Assistant Examiner*—Sebastiano Passaniti
*Attorney, Agent, or Firm*—Kenway & Crowley

[57] ABSTRACT

An aid for gripping implements or objects, particularly in athletic and sporting endeavors. A fabric member impregnated with non-slip material is attached in layered fashion to a terry-cloth towel which is so arranged to enclose and protect the impregnated layer when the layered structure is held in a folded position by detachable members. Portability of the gripping aid is made possible by means of a suitable hanger.

1 Claim, 1 Drawing Sheet

GRIPPING AID

BACKGROUND OF THE INVENTION

This invention relates in general to the improvement of gripping and particularly to athletic and sporting gripping.

In every sport in which a hand-held implement is involved, the problem of secure gripping is involved. Specific sports which come to mind immediately include baseball, tennis, golf, hockey, lacrosse, polo, cricket, and the like. Also, gripping in sports is a factor when a secure grip on the ball being used is needed. For example, nothing is more ubiquitous than the rosin bag at the pitcher's mound in baseball.

Reverting to gripping of an implement, however, the use of special materials for grips and the wearing of gloves by golfers as well as hitters in baseball has become almost universal. Various substances such as the notorious pine-tar on baseball bats and tacky compounds applied to the grips of golf clubs and tennis racquets are also common.

Despite the proliferation of gripping aids, a need exists for a convenient, inexpensive and durable solution to the gripping problem. That solution should not involve any noxious materials and should not require containers which can be misplaced or require special storage for easy availability.

The principal object of the present invention is to solve the gripping problem in a manner which meets the need outlined above.

A further object of the present invention is to make available and convenient a gripping aid for hand-held athletic or sporting items.

Another object is the provision of a durable, simple and effective aid for gripping.

Still another object is the provision of a sanitary aid for gripping.

Yet another object is an inexpensive gripping aid which can be conveniently disposed at or near the point at which it is needed.

SUMMARY OF THE INVENTION

Generally, the invention resides in a layered structure of flexible materials, one layer of which is impregnated with non-slip material and another layer of which is so disposed as to normally enclose and cover the impregnated layer. Size of the preferred embodiments of the invention is not critical and may be adjusted to suit requirements of portability (as on a golf bag) or heavy use at a fixed station (as in a baseball dugout). Quick release fasteners are employed to permit easy access to the impregnated layer and suitable hangers and engagements permit the gripping aid to be supported for hand contact and wiping. For a better understanding of the present invention, together with other and further objects, features, and advantages, reference should be had to the following description of a preferred embodiment which should be read in conjunction with the appended drawing in which:

DESCRIPTION OF PREFERRED EMBODIMENT

Figure 2:
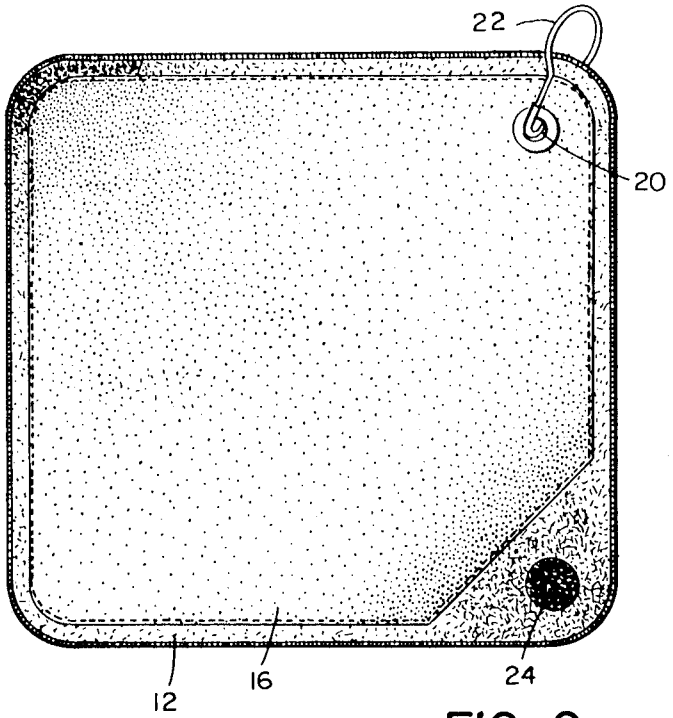
FIG. 2 is a front elevation of a preferred embodiment showing the gripping aid unfolded and the impregnated layer exposed for use.
Figure 1:
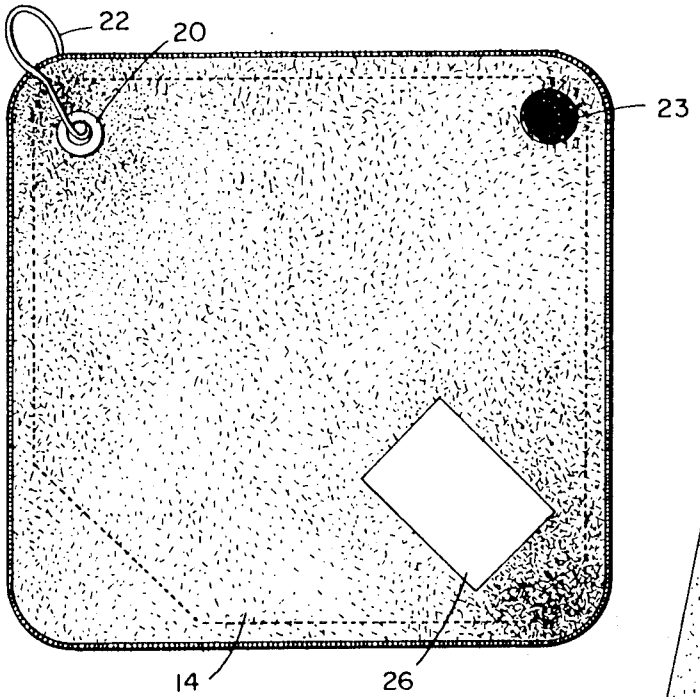
FIG. 1 is a front elevation of a preferred embodiment of the invention showing the gripping aid unfolded, a hanger, and a logo on the outside of the aid.

In FIGS. 1 and 2, there is shown a form of the invention suitable for use by a golfer. It includes a layer of towelling 12 which may include a border 14. The material is desirably conventional closed-loop terry cloth and, in fact, a commonly available 12"×12" face towel has proven suitable. To the layer of towelling a layer of imitation chamois cloth 16 is attached by conventional sewing, heat sealing or cementing. The layer 16 is preferably somewhat smaller in area than the layer 12 to provide a degree of protection from unwanted contact with the layer 16.

An opening is formed by conventional means through the dual layers adjacent a corner of the rectangular structure and a grommet 20 is fixed in the opening. A suitable engagement device such as the hanger 22 may be disposed in the grommet 20 to permit the gripping aid to be hung on a golf bag, for example.

At a corner 90° removed from the corner at which the grommet 20 is inserted, the chamois layer 16 may be cut back to expose a portion of the layer 12. In that portion of the layer 12, a patch 23 of hook-and-loop material may be attached by sewing, cementing or heat-sealing. The corner opposite that at which the patch 22 is attached accommodates the second matching hook-and-loop member 24. In order that the hook-and-loop members can serve to hold the toweling layer 12 in an enclosing relationship to the chamois layer 16, the second hook-and-loop member 24 is attached at the undersurface of the layer of towelling 12.

Figure 3:
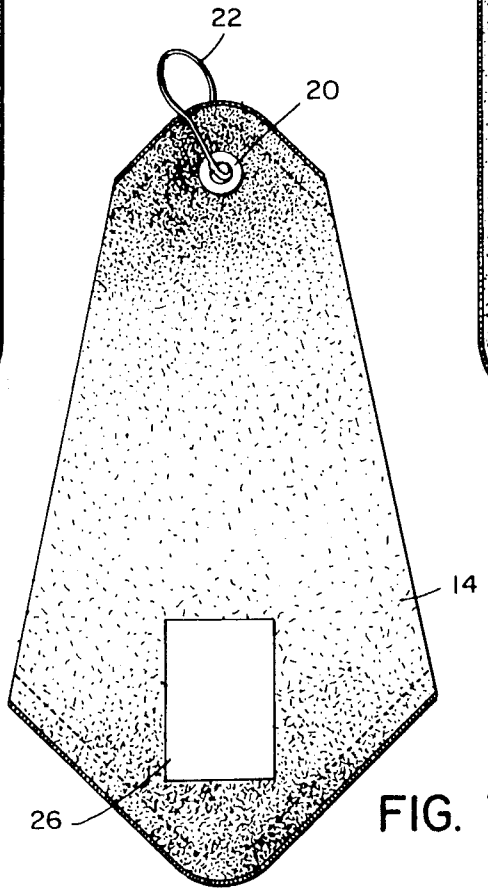
FIG. 3 is a rear elevation of the embodiment of FIG. 1 showing the gripping aid folded and the impregnated layer enclosed.

In FIG. 3, the gripping aid of the invention is shown in folded condition. It will be noted that the chamois layer 16 is so enclosed that no portion of it is exposed to the elements. Although the chamois layer 16 is so impregnated with non-slip material that it remains useful as a source of non-slip material when the hands are wiped over the layer, its usefulness is prolonged even more greatly by reason of its protective cover provided by the layer 12 folded about it.

In the bottom corner on the surface exposed when the gripping aid is folded, a logo or monogram 26 may be displayed. The placement of the logo when a gripping aid is carried on a golf bag is such that it serves as a highly visible point for advertising.

Reference has been made throughout the specification to non-slip material. The preferred material is a vegetable oil adhesive such as refined edible cottonseed oil. The cottonseed oil is processed with calcium hydroxide and sulfur monochloride to make it sticky rather than slippery. Any of several additives of perfume or odorant maybe included in the non-slip composition to maintain a fresh and pleasant smell. The non-slip material may be applied to the chamois by dipping, spraying, or a roll-on transfer By way of example, the non-slip material may be prepared by mixing 450 lbs. of cottonseed oil with 4 lbs. of calcium hydroxide and 74 lbs. of sulfur monochloride. The oil and calcium hydroxide are well mixed for a period of several hours, following which a quarter of the sulfur monochloride is added each hour for four hours as the mixing continues. Ten minutes after the final addition of sulfur monochloride, five gallons of rubber solvent (heptane or hexane) are stirred into the mix.

The layer of towelling 12 may be, as noted above, made from conventional terrycloth towelling. The layer of immitation chamois cloth 16 is preferably polyester made by Clean-Rite Products Co., 600 Wharton Circle SW, Atlanta, Ga. 30378, sold under the name ULTRA DRY.

What is claimed is:

1. An aid for improving the gripping of a hand-held sporting implement comprising a generally rectangular piece of towelling, a similarly shaped but smaller piece of artificial chamois cloth attached in underlying relationship to said piece of towelling, said chamois cloth being impregnated with non-slip material, an opening being formed through a corner of said towelling, a grommet disposed in said opening, a hanger engaging said grommet, and hook-and-loop fasteners disposed on opposite faces of said towelling to hold the toweling and chamois cloth in a normally folded condition.

* * * * *